United States Patent [19]

Honegger

[11] Patent Number: 4,953,847

[45] Date of Patent: Sep. 4, 1990

[54] METHOD OF AND APPARATUS FOR OUTFEEDING PRINTED PRODUCTS ARRIVING IN AN IMBRICATED FORMATION

[75] Inventor: Werner Honegger, Tann-Ruti, Switzerland

[73] Assignee: Ferag AG, Hinwil, Switzerland

[21] Appl. No.: 316,339

[22] Filed: Feb. 27, 1989

[30] Foreign Application Priority Data

Mar. 3, 1988 [CH] Switzerland ..... 00809/88

[51] Int. Cl.[5] ..... B65H 5/08

[52] U.S. Cl. ..... 271/277; 271/204

[58] Field of Search ..... 271/277, 82, 204, 205, 271/206

[56] References Cited

U.S. PATENT DOCUMENTS

| | | | |
|---|---|---|---|
| 4,201,286 | 5/1980 | Meier | 271/206 X |
| 4,320,894 | 3/1982 | Reist | 271/204 X |
| 4,333,559 | 6/1982 | Reist | 271/204 X |
| 4,512,457 | 4/1985 | Reist | 271/205 X |
| 4,566,687 | 1/1986 | Faltin | 271/204 X |
| 4,729,554 | 3/1988 | Honegger | 271/204 X |

FOREIGN PATENT DOCUMENTS

| | | | |
|---|---|---|---|
| 8603476 | 6/1986 | European Pat. Off. . | |
| 241634 | 10/1987 | European Pat. Off. | 271/204 |
| 0242702 | 10/1987 | European Pat. Off. . | |
| 2822060 | 12/1978 | Fed. Rep. of Germany . | |
| 2272936 | 12/1975 | France . | |
| 966402 | 8/1964 | United Kingdom . | |
| 2024176 | 1/1980 | United Kingdom . | |

*Primary Examiner*—Richard A. Schacher

*Attorney, Agent, or Firm*—Willian Brinks Olds Hofer Gilson & Lione

[57] ABSTRACT

The band or belt conveyor conveys the printed products arranged in an imbricated formation to a take-over region. In the imbricated formation, each printed product lies upon the next following or trailing printed product. An outfeed device, whose conveying direction extends in the take-over region from below towards the top, comprises grippers pivotably mounted at a revolvingly driven traction element. The conveying speeds of the band or belt conveyor and the outfeed device, respectively, are co-ordinated such that in each case two infed printed products are introduced into one open gripper. The depth of the grippers is larger than the spacing or pitch between the leading product edges of the printed products in the infed imbricated formation, so that the two printed products engaged or seized by one gripper can be outfed with unchanged mutual spacing or pitch. Imbricated formations can be thus formed during delivery or outfeed of the printed products. In such imbricated formations the printed products are arranged at an imbricated spacing or pitch which is substantially the same as the original spacing or pitch.

16 Claims, 3 Drawing Sheets

METHOD OF AND APPARATUS FOR OUTFEEDING PRINTED PRODUCTS ARRIVING IN AN IMBRICATED FORMATION

CROSS-REFERENCE TO RELATED PATENT APPLICATION

This application is related to the commonly assigned, copending U.S. patent application Ser. No. 07/292,989, filed Jan. 3, 1989, entitled "APPARATUS FOR CONVEYING SUBSTANTIALLY FLAT PRODUCTS, ESPECIALLY PRINTED PRODUCTS".

BACKGROUND OF THE INVENTION

The present invention broadly relates to infeeding and outfeeding of substantially flat articles or products from an imbricated formation and, more specifically pertains to a new and improved method of outfeeding printed products, particularly multi-sheet and preferably folded printed products, which are infed in an imbricated formation, arranged in tandem or succession and located at a predetermined spacing or pitch from one another, and imbricatingly overlap one another. Moreover, in each case at least two printed products are collectively engaged in the region of their leading edges by grippers or gripper elements of an outfeed device. The present invention also relates to a new and improved apparatus for outfeeding such printed products.

Such an apparatus is known, for example, from Swiss Patent No. 630,583 and its cognate U.S. Pat. No. 4,320,894, granted Mar. 23, 1982 and the British Patent No. 2,024,176, published Jan. 9, 1980. An infeed device or infeed conveyor of this known apparatus transports the printed products in an imbricated formation, during which each printed product bears upon the next following or trailing printed product, to a take-over region.

An outfeed device or outfeed conveyor comprises individually controllable grippers arranged in tandem or succession at a revolvingly driven traction element and at a mutual spacing or distance from one another. The conveying direction of the outfeed device in the take-over region extends essentially transversely with respect to the plane of the printed products to be engaged and furthermore from the underside of the printed products towards the upper side of such printed products. In this known apparatus, each gripper in each case engages in the take-over region one infed printed product and peels off or removes this one engaged infed printed product from the imbricated formation. By appropriately reducing the conveying speed of the outfeed device in relation to the conveying speed of the infeed device and by reducing the imbricated spacing or pitch of the arriving imbricated product stream, it is however also possible to engage and outfeed, by means of a single gripper, two or more printed products. Owing to the reduction of the conveying speed of the outfeed device, the leading edge of the foremost printed product of the infed imbricated formation travels against a stop element or rail such that the imbricated spacing or pitch is reduced and the next following printed product travels further under the preceding or downstream printed product until these two printed products are mutually outfed.

The reduced imbricated spacing or pitch between the two printed products engaged in each case by one or a single gripper is particularly suitable for further processing of printed products in a device as known from and disclosed in European patent application No. 0,237,701 and its cognate U.S. Pat. No. 4,709,910, granted Dec. 1, 1987. In this known apparatus, the free ends of the two printed products held by a gripper or gripper element are separated from one another by means of the reduced imbricated spacing or pitch and introduced, in each case, into different pockets or compartments of a revolving drum.

On the other hand, if for further processing of the printed products there is again required an imbricated formation in which the printed products are arranged having their original spacing or pitch, then following the known outfeeding apparatus there must be arranged a further apparatus which again increases the reduced spacing or pitch between the two printed products engaged or seized by one individual gripper. This entails considerable additional structural resources.

SUMMARY OF THE INVENTION

Therefore with the foregoing in mind it is a primary object of the present invention to provide a new and improved method of outfeeding printed products, particularly multi-sheet and preferably folded printed products, which are infed in an imbricated formation, arranged in tandem or succession and at a predetermined spacing from one another, and imbricatingly overlap one another, which method does not suffer from the aforementioned drawbacks and shortcomings of the prior art constructions.

Another and more specific object of the present invention aims at providing a new and improved method of outfeeding printed products in that by utilizing the advantages of a reduced or lower conveying speed of the outfeed device owing to engaging or seizing, in each case or each time, at least two printed products for further processing of such printed products without having to increase again the imbricated spacing or pitch, imbricated formations can be again formed in which the spacing or pitch between the leading edges of the printed products substantially corresponds with the imbricated spacing or pitch in the infed imbricated formation.

Now in order to implement these and still further objects of the invention which will become more readily apparent as the description proceeds, the method of outfeeding printed products, particularly multi-sheet and preferably folded printed products, among other things, is manifested by the steps of infeeding the printed products in an imbricated overlapping formation, each time engaging at least two printed products having the predetermined spacing or pitch which they occupied or possessed in the infed imbricated formation, retaining the at least two printed products having the predetermined spacing or pitch, and outfeeding the at least two printed products having the predetermined spacing or pitch.

In accordance with the inventive method, at least two printed products are engaged and retained by one individual or common gripper of the outfeed device without reducing the spacing or pitch which they occupied in the infed imbricated formation. Upon delivery or outfeed of these printed products it is thus possible without further process steps to form imbricated formations in which the leading edges of the printed products again occupy the original spacing or pitch with which they were conveyed to the take-over region.

The printed products can be preferably arranged in an imbricated formation in which each printed product bears upon the next following or trailing or upstream printed product, and conveyed in an outfeed direction which extends substantially parallel to the infeed direction or extends essentially upwardly from the underside of the printed products to be engaged.

It is also preferable to arrange the printed products in an imbricated formation in which each printed product bears upon the next preceding or leading or upstream printed product and to convey the printed products in an outfeed direction which extends substantially parallel to the infeed direction or extends essentially downwardly from the upper side of the printed products to be engaged.

As alluded to above, the invention is not only concerned with the aforementioned method of outfeeding printed products, but also relates to a novel construction of an apparatus for outfeeding printed products arriving in an imbricated formation.

Generally speaking, the inventive apparatus for outfeeding printed products, particularly multi-sheet and preferably folded printed products which are infed in an imbricated formation, arranged in tandem or succession and at a predetermined spacing or pitch from one another, and imbricatingly overlap one another, comprises an infeed device for infeeding the printed products to a take-over region and an outfeed device having individually controllable grippers or gripper elements arranged in tandem or succession, such grippers serving to engage in each case or each time at least two of the infed printed products in the region of their leading edges.

In an advantageous embodiment of the inventive apparatus, the engaged or seized printed products are upwardly or downwardly peeled off or removed from the infed imbricated formation, so that the next following gripper can engage or seize without any difficulty the next two printed products in the region of their leading edges and deliver or outfeed such printed products.

In a particularly preferred embodiment of the inventive apparatus for outfeeding printed products, each individually controllable gripper or gripper element comprises two clamping jaws or jaw members of which one is controllable. The free end of the leading clamping jaws in each case maintains in the product take-over region its position with respect to the plane of the printed products to be engaged when two printed products travel between the clamping jaws into an open gripper. In this manner, a mutual displacement of the engaged or seized printed products is avoided during infeed of the printed products between the clamping jaws or when the gripper is closed.

In a further embodiment of the apparatus constructed according to the invention, each gripper of the outfeeding device engages in each case or each time one single printed product of the printed products infed in an imbricated formation, whereby the individually controllable grippers at a revolvingly driven machine element are journaled at a pivot axle and pivotable in a take-over region by means of a control member. The predetermined conveying direction of the outfeeding device extends essentially transversely to a plane of the printed product to be engaged. The trailing or upstream clamping jaw is controllable and each gripper or gripper element in the take-over region is pivotable by means of the control member such that the free end of the preceding or downstream clamping jaw remains essentially stationary during the entry of the one single printed product between the two printed products.

In a first embodiment of the grippers, the trailing clamping jaw constitutes the one controllable clamping jaw. The coacting clamping jaws at the revolvingly driven traction element are conjointly pivotable about pivot shaft means. Cam means are provided for rocking or pivoting the individually controllable grippers in the product take-over region in order to maintain substantially stationary the free end of the leading clamping jaw.

In a second embodiment of the grippers, the leading clamping jaw constitutes the one controllable clamping jaw. Cam means in the product take-over region maintain the position of the leading clamping jaw with respect to the plane of printed products to be engaged until the trailing clamping jaw clamps the products together with the controllable leading clamping jaw.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
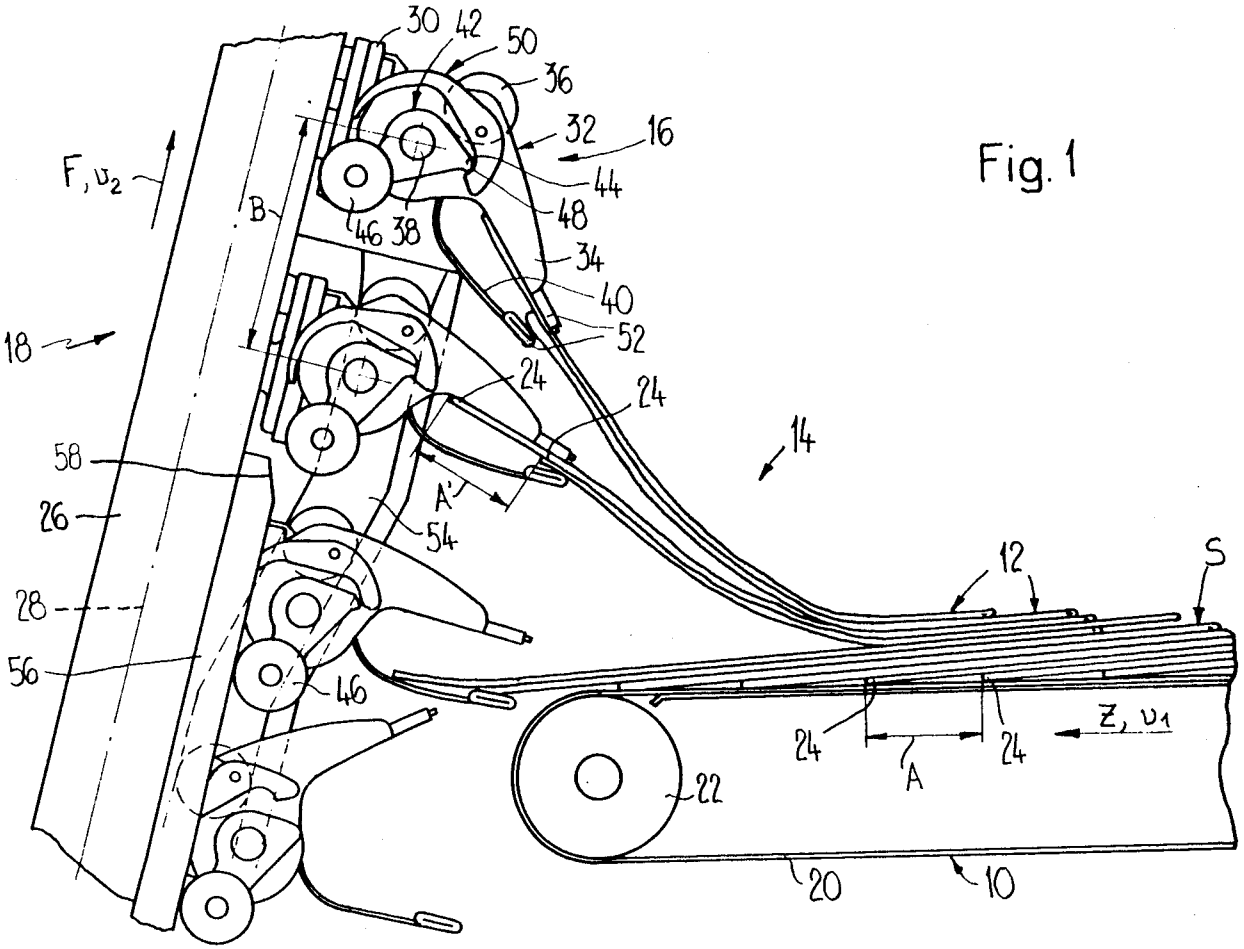
FIG. 1 schematically shows a first embodiment of the apparatus constructed according to the invention.
Figure 2:
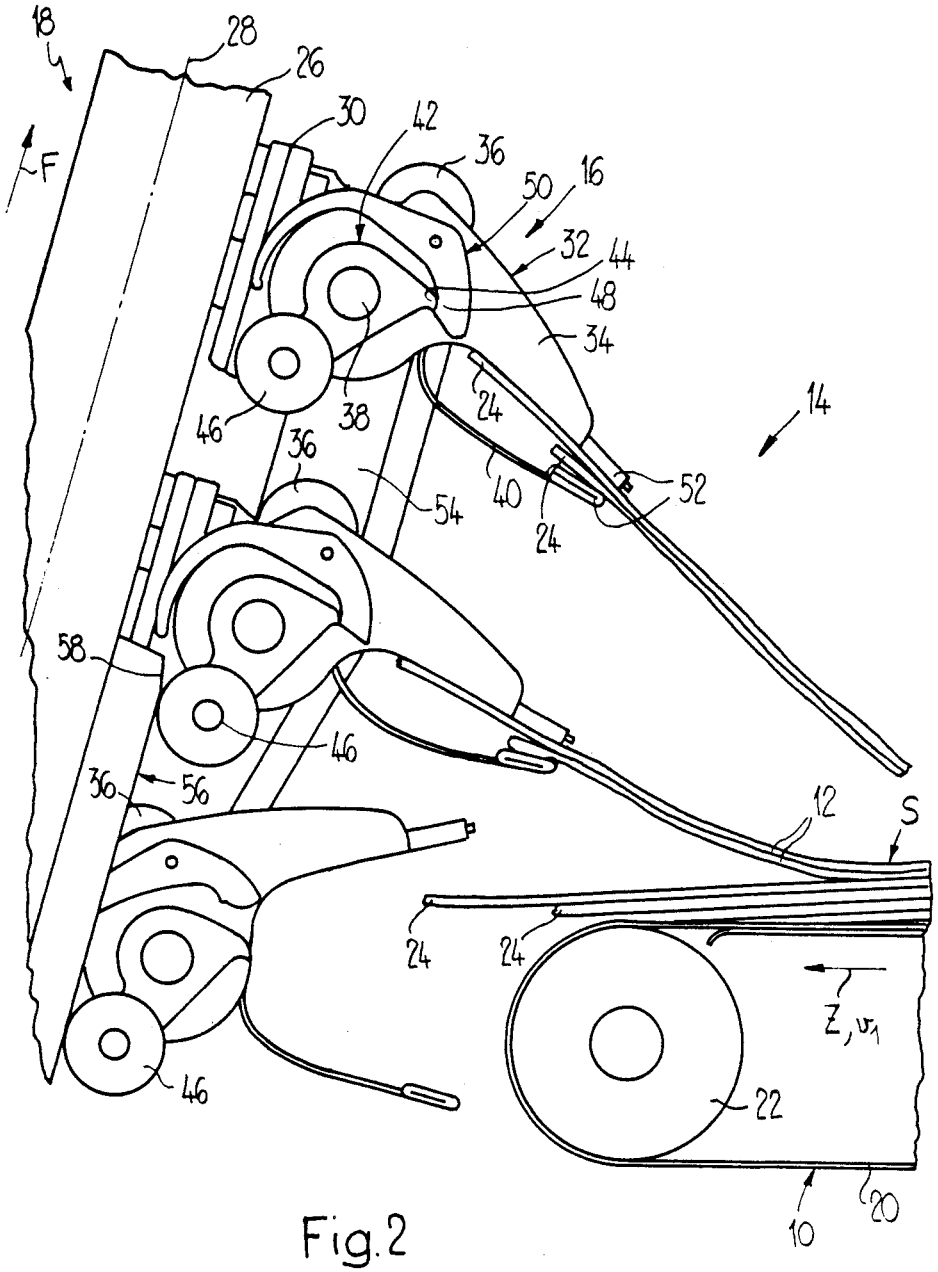
FIG. 2 schematically shows, on an enlarged scale, a portion of the apparatus shown in FIG. 1.

Describing now the drawings, it is to be understood that to simplify the showing thereof, only enough of the construction of the exemplary embodiments of apparatus for outfeeding printed products arriving in an imbricated formation has been illustrated therein as is needed to enable one skilled in the art to readily understand the underlying principles and concepts of this invention. Turning now specifically to FIGS. 1 and 2 of the drawings, the apparatus illustrated therein by way of example and not limitation will be seen to comprise the depicted end region of a band or belt conveyor 10 which supplies an imbricated or shingled formation S of folded printed products 12, for example, newspapers, magazines, periodicals or parts thereof, to a product take-over region 14, in which in each case or each time, two printed products 12 are engaged and outfed by a gripper or gripper element 16 of an outfeed device or outfeed conveyor 18 which is also only partially illustrated.

An endless band or belt 20 of the band or belt conveyor 10 is guided in the take-over region about a deflection roll 22 and is revolvingly driven in the infeed direction Z by means of a suitable drive or drive mechanism not particularly illustrated in the drawings. In the imbricated or shingled formation S, each printed product 12 bears upon the next following or trailing or upstream printed product 12 as viewed in the infeed direction Z, and the leading product edges 24 of the printed products 12 are arranged at a spacing or pitch A from one another as indicated by the double-headed arrow in FIG. 1. The conveying speed of the band or belt conveyor 10 is designated by the reference character $V_1$.

The outfeed device or outfeed conveyor 18 comprises a traction element or traction means 28 guided in a guide channel 26 and revolvingly driven with a conveying speed $V_2$ in the conveying or feed direction F. The traction element or traction means 28 schematically indicated in dash-dotted lines in FIGS. 1 and 2 is, for example, a ball-and-socket link chain as has been fully described in German Patent Publication No. 2,629,528 and its cognate U.S. Pat. No. 4,294,345, granted Oct. 13, 1981. To the revolvingly driven traction element or traction means 28 there are attached cantilevers or brackets 30 arranged in tandem or succession and in a spaced relationship to one another. At each cantilever or bracket 30 there is mounted a gripper housing 32 of a gripper or gripper element 16 which is pivotable about an axis which perpendicularly extends to the plane of the drawings and is not particularly illustrated in FIGS. 1 and 2. The center-to-center distance or spacing between two neighboring or adjacent grippers 16 is designated by the reference character B as shown in FIG. 1. These grippers or gripper elements 16 substantially correspond in construction, function and operation with the grippers disclosed, for example, in Swiss Patent No. 644,816 and its cognate U.S. Pat. No. 4,381,056, granted Apr. 26, 1983. Such grippers 16 will be therefore hereinafter described only so far as is required for understanding their operation or function.

The leading clamping jaw or jaw member 34 is constructed as a part of the gripper housing 32, at which a laterally projecting pivoting roll or roller 36 is also rotatably mounted. Furthermore, a shaft 38 extending parallel to the pivoting axis or axle is pivotably mounted in the gripper housing 32. At the central portion of this shaft 38 there is fastened a substantially tongue-shaped clamping jaw 40 formed of spring steel. In the gripper housing 32, there is provided a coil or spiral spring which extends around the shaft 38 and is not particularly illustrated in FIGS. 1 and 2. This coil or spiral spring bears at one end against the gripper housing 32 and at the other end is supported at the shaft 38. Furthermore, this coil or spiral spring biases the shaft 38 and thus the clamping jaw 40 toward the open position of the associated gripper or gripper element 16. As viewed in the conveying or feed direction F, the rearmost gripper 16 is shown in the open position in FIG. 1.

The end portion of the shaft 38 visible in FIGS. 1 and 2 penetrates the gripper housing 32 and projects beyond this gripper housing 22. A closing lever 42 is non-rotatably seated at this end portion of the shaft 38. This closing lever 42 is structured as a two-armed or double-arm lever. At the one arm directed at the clamping jaws 34 and 40 there is formed an arresting lug or nose 42, and at the other arm directed, as viewed in the conveying or feed direction F, toward the rear and the guide channel 26 there is rotatably mounted a closing roll or roller 46. The arresting lug or nose 44 cooperates with a locking groove 48 arranged at a ratchet lever 50 which is pivotably journalled at the gripper housing 32 and biased in the clockwise direction. The end region of the ratchet lever 50, which end region is remote from the locking groove 48, projects in the direction towards the guide channel 26 and is bent to the rear with respect to the conveying or feed direction F. The clamping jaws 34 and 40 carry a rubber coating or surfacing 52 at their free end portions in order to prevent damaging the seized printed products 12 and also to increase the static friction. The function or operation of the gripper or gripper element 16 will be described hereinbelow in greater detail.

In the product take-over region 14 there is provided at the guide channel 26 pivot cam means 54 in which the pivoting roll or roller 36 mounted at the gripper housing 33 is guided. The distance or spacing between the guide channel 26 and the pivot cam means 54, viewed in the conveying or feed direction F, is a minimum up to the region of an imaginary elongation or projection to the conveyingactive run of the band or belt conveyor 10, increases in an adjoining or following region and is then again constant up to the end of the pivot cam means 54. At the guide channel 26 there is also fastened a closing cam means 56 which acts upon the closing roll or roller 46. This closing cam means 56, viewed in the conveying or feed direction F, extends to the region in which the pivot cam means 54 possesses the largest distance or spacing with respect to the guide channel 26. This closing cam means 56 comprises at its end region a roll-off or discharge edge 58.

Viewed in the conveying or feed direction F, the two foremost grippers or gripper elements 16 are shown in the gripper closed position and in each case retain by means of their clamping jaws 34 and 40 two printed products 12 in the region of the leading product edges 24 thereof. It is to be noted in this connection that the depth of the gripper or gripper element 16 in the region of the clamping jaws 34 and 40 is larger than the spacing or distance A' between the leading edges 24 of the two printed products 12 held or retained by an associated gripper or gripper element 16 (FIG. 1). The spacing or distance A' corresponds to the spacing or pitch A between the leading edges 24 of the printed products 12 in the infed imbricated formation S. The third gripper 16 is shown during the closing process, and the fourth gripper 16 illustrated in FIG. 1 is still in the gripper open position.

In the course of the description of the operation of the apparatus illustrated in FIGS. 1 and 2, one gripper or gripper element 16 will be pursued in its travel through the take-over region 14 in the conveying or feed direction F. Due to the short distance or spacing between the pivot cam means 54 and the guide channel 26, the gripper housing 32 at the beginning of the take-over region 14 is pivoted in counter-clockwise direction in such a manner, that the leading clamping jaw 34 with respect to the conveying or feed direction F is inclinedly directed in the forward direction as depicted in FIG. 1 with reference to the rearmost or trailing gripper 16. As soon as the pivoting roll or roller 36 reaches that region of the pivot cam means 54 in which the distance between the pivot cam means 54 and the guide channel 26 increases, the gripper housing 32 is pivoted in clockwise direction as depicted in FIG. 2 with reference to the rearmost gripper 16.

The traction element or traction means 28 as well as the band or belt conveyor 10 are synchronized such that at the beginning of this pivoting process or procedure the leading product edge 24 of the foremost printed product 12 of the imbricated formation S moves into and between the clamping jaws 34 and 40 as is illustrated in FIG. 2. Since the closing roll or roller 46 rides on the closing cam means 56 and, in turn, the closing cam means 56 extends approximately parallel to the guide channel 26, the next following or trailing clamping jaw 40 maintains its direction with respect to the conveying or feed direction F, resulting in the closing motion of the gripper 16 because of the pivoting motion of the gripper housing 32 and thus also of the leading clamping jaw 34. During this closing motion, the printed product 12 following the first introduced printed product 12 moves in between the clamping jaws 32 and 40 as can been seen in FIG. 1. Shortly before the pivoting roll or roller 36 reaches the end of the part of the pivot cam means 54, which part diverges from the guide channel 26, the arresting lug or nose 44 of the two-armed closing lever 42 bears against the ratchet lever 50, and pivots back this ratchet lever 50 in counter-clockwise direction until the arresting lug or nose 44 locks in the locking groove 48. As soon as the rubber coating or surfacing or covering 52 of the trailing clamping jaw 40 presses the engaged or seized printed products 12 against the rubber coating or surfacing or covering 52 of the leading clamping jaw 34 during the closing motion of the gripper or gripper element 16, the pressure or pressing force is increased due to the spring qualities of the trailing clamping jaw 40 such that the two engaged or seized printed products 12 are firmly retained. During further travel in the conveying or feed direction F, the closing cam means 56 release the closing roll or roller 46 in the region of the roll-off or discharge edge 58, so that the trailing clamping jaw 40 is now retained in the closed gripper position solely by the ratchet lever 50 (cf. the two foremost or leading grippers 16 in FIGS. 1 and 2).

The printed products 12 engaged and seized by a gripper or gripper element 16 are removed or peeled off from the imbricated formation S without any change of the spacing or pitch A or A' between the leading product edges 24. In this manner, the leading product edge 24 of the foremost or leading printed product 12 of the imbricated formation S is exposed. For the release of the printed products 12 held by the grippers 16, the pivoting rolls or rollers 36 are again driven into a suitable pivot cam means not particularly shown in the drawings, and the ratchet or latching lever 50 rides upon an opening cam means also not particularly illustrated in the drawings. This opening cam means pivots the ratchet lever 50 in counter-clockwise direction and thus releases the arresting lug or nose 44 and the two-armed closing lever 42. In this manner, the trailing clamping jaw 40 is automatically returned to the open gripper position and the printed products 12 are available with unchanged or unaltered imbricated spacing or pitch A or A' for further processing. It is thus readily conceivable that an imbricated formation can again be formed without any problem and without further measures. The spacing or pitch A or A' of the printed products 12 in such a newly formed imbricated formation is substantially unchanged with respect to the spacing or pitch A or A' of the printed products 12 in the arriving or infed imbricated stream S.

Figure 3:
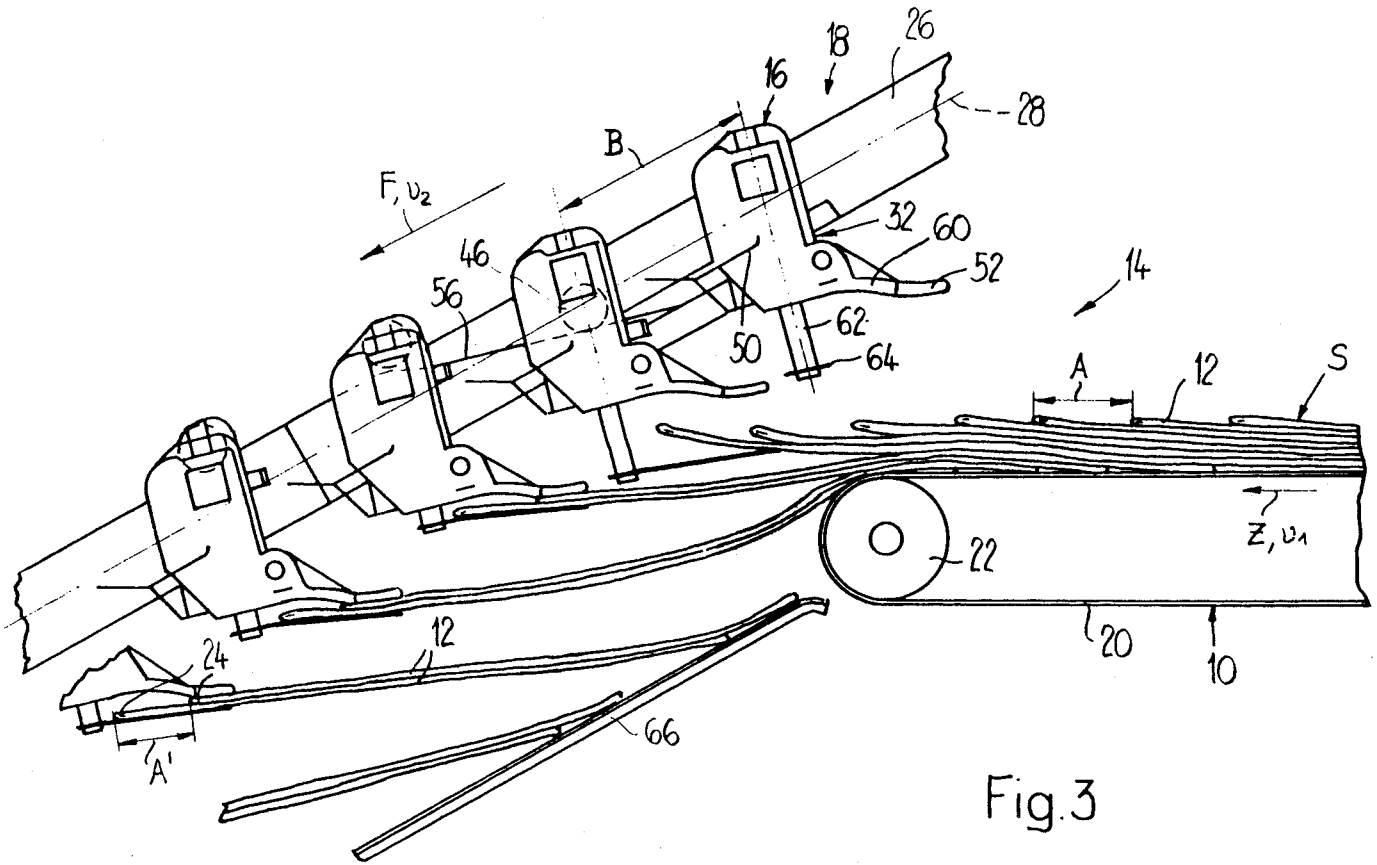
FIG. 3 schematically shows the transfer region of a second embodiment of the apparatus constructed according to the invention.

The band or belt conveyor 10 of the second exemplary embodiment according to FIG. 3 also comprises an endless band or belt 20 revolvingly driven in the infeed direction Z. This endless band or belt 20 is guided about the deflection roll 22. In the imbricated formation S of the products 12 as conveyed by the band or belt conveyor 10 to the take-over region 14, each printed product 12 bears upon the next preceding or downstream printed product.

The conveying or feed direction F of the outfeed device or outfeed conveyor 80 extends, as viewed in the infeed direction Z, from the upper side of the printed products 12 inclinedly towards the lower side thereof. The outfeed device or outfeed conveyor 18 also comprises a guide channel 26 in which a revolvingly driven traction element or traction means 28 is guided. To this traction element or traction means 28 indicated by dash-dotted lines in FIG. 3 there are also attached in tandem or successive arrangement individually controllable grippers or gripper elements 16 which have a center-to-center distance or spacing B from one another. The construction and the operation of these grippers 16 are described, for example, in Swiss Patent No. 592,562 and its cognate U.S. Pat. No. 3,955,667, granted May 11, 1976. The gripper housing 32 is not pivotably fastened to the traction element or traction means 28. The stationary clamping jaw 60 is structured at the traction element or traction means 28.

A shaft 62 is displaceable in the gripper housing 32 in the direction of its longitudinal axis and mounted for pivoting about this longitudinal axis. This longitudinal axis of the shaft 62 extends essentially transversely with respect to the conveying or feed direction F and is disposed approximately perpendicular to the plane of the printed products 12 to be engaged. The shaft 62 is biased toward the open gripper position as depicted in FIG. 3 with reference to the rearmost gripper or gripper element 16 as viewed in the conveying or feed direction F. The clamping jaw 64 fastened to the shaft 62 is pivoted by approximately 90° with respect to the conveying or feed direction F. With the shaft 62 there is operatively connected the closing roll or roller 46 which upon riding on the closing cam means 56 fastened to the guide channel 26 guides the shaft 62 and therefore also the clamping jaw 64 into the closed position of the gripper 16. The shaft 62 is thus pivoted through an angle of approximately 90° such that the clamping jaw 64, viewed in the conveying or feed direction F, is directed to the rear and approximately parallel to the clamping jaw 60 as depicted in connection with the second rearmost gripper or gripper element 16.

During further transport of the grippers 16, the shaft 62 is completely closed and clamps the printed products 12 fed in by the band or belt conveyor 10 between the free ends of the clamping jaws 60 and 64. The shaft 62 is retained in the closed position by means of the ratchet or latching lever 50. In the gripper or gripper element 16 shown in FIG. 3, the free end of the trailing stationary clamping jaw 60 is coated with a rubber surfacing or covering 52. The spacing or pitch between the leading edges 24 of two printed products 12 engaged or seized by a gripper 16 is designated by the reference character A' and corresponds with the spacing or pitch A between the leading edges 24 of the printed products 12 in the infed imbricated formation S. The depth of the grippers 16 is larger or longer than this spacing or pitch A' or A, respectively. Arranged following the band or belt conveyor 10 is a guide plate 66 which extends parallel to the conveying or feed direction F of the outfeed device or outfeed conveyor 18 and at which slide the trailing or upstream edges of the outfed printed products 12.

The speed of the outfeed device or outfeed conveyor 18 is designated with the reference character $V_2$. The conveying speed $V_1$ of the band or belt conveyor 10 and the conveying speed $V_2$ of the outfeed device or outfeed conveyor 18 are selected such that during the time in which the infed printed products 12 cover the distance of twice the spacing or pitch A between two printed products 12, the grippers or gripper elements 16 of the outfeed device 18 are transported further by the center-to-center distance or spacing B between the grippers 16. In other words, the ratio of the conveying speed $V_1$ of the band or belt conveyor 10 to the conveying speed $V_2$ of the outfeed device 18 essentially corresponds with the quotient of the center-to-center distance B between two individually controllable grippers 16 to twice the spacing or pitch A between the leading product edges of two adjacent printed products 12 in the imbricated formation. It is thus ensured that two printed products 12 are fed into each gripper 16.

In this connection, it is worthy of mention that the closing cam means 56 extends substantially parallel to the infeed direction Z and is arranged such that the leading controllable clamping jaw 64 can substantially maintain its position with respect to the conveying or conveyance plane of the band or belt conveyor 10 and thus with respect to the plane of the printed products 12 to be engaged or seized.

Having now had the benefit of the foregoing discussion of the second exemplary embodiment of the apparatus for outfeeding printed products, its mode of operation is described and is as follows:

The grippers 16 reach the open gripper position in the product take-over region 14. The band or belt conveyor 10 and the outfeed device or outfeed conveyor 18 are synchronized such that upon travel of the closing roll or roller 46 on the closing cam means 56 and thus upon pivoting of the clamping jaw 64, this clamping jaw 64 comes to bear against the underside of the front or leading printed product 12 in the region of the leading product edge 24 of the rear or trailing printed product 12 to be engaged. During the further closing process or closing procedure, the relative movement between the controllable clamping jaw 64 and the printed products 12 to be engaged is relatively negligible, and while this clamping jaw 64 is held by the closing cam means 56 in its position with respect to the plane of the printed products 12 to be engaged, the clamping jaw 60 displaced in the conveying or feed direction F approaches from above the printed products 12 to be engaged until these printed products 12 are clamped between both clamping jaws 60 and 64. The seized printed products 12 are outfed in the downward direction, so that the leading edges 24 of the next printed products 12 to be engaged are freely exposed.

For the delivery or outfeed of the seized printed products 12, the ratchet or latching levers 50 are pivoted in clockwise direction by opening cam means not particularly illustrated in the drawings, with the result that the shaft 62 and the clamping jaw 64 fixed thereto are lead back or returned to the open gripper position and the released printed products 12 having the original spacing or pitch A or A' are deposited, for example, on a band or conveyor, upon which there is again formed an imbricated formation which comprises the original spacing or pitch A or A' between the leading product edges 24.

It is to be noted that the conveying or feed direction F in the apparatus according to FIG. 3, in which each printed product 12 bears upon the next preceding or downstream or leading printed product 12 in the infed imbricated formation S, is approximately parallel to the infeed direction Z or, as shown in FIG. 3, is directed from the upper side of the printed products 12 toward the lower side thereof. In the case of a conveying or feed direction F which extends approximately parallel to the infeed direction Z, the gripping of the printed products 12 to be engaged in the region of their leading product edges 24 is ensured in that the downwardly projecting free end of the shaft 24 downwardly presses the printed products 12 already engaged by the preceding or leading gripper 16 and thus freely exposes the leading edges 24 to be engaged.

It is obvious that in both exemplary embodiments of the apparatus the grippers 16 in each case engage and outfeed only one single printed product 12 by decreasing the conveying speed $V_1$ of the band or belt conveyor 10 or by increasing the conveying speed $V_2$ of the outfeed device 18, or at constant or steady speeds $V_1$ and $V_2$ by doubling the spacing or pitch A between the leading product edges 24 of the printed products 12 in the infed imbricated formation.

It is naturally also possible to structure the illustrated exemplary embodiments and particularly the grippers 16 such that in each case three or even more printed products 12 can be engaged and outfed by each gripper 16, whereby also in such a case the spacing or pitch between the printed products 12 remains essentially the same.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of outfeeding printed products, particularly multi-sheet and preferably folded printed products, comprising the steps of:

infeeding in an imbricated formation the printed products arranged in tandem and at a predetermined spacing and imbricatingly overlapping one another;

engaging each time at least two printed products in region of leading edges thereof by means of grippers of an outfeed device;

said step of engaging each time at least two printed products entailing the engagement of at least two printed products by a single gripper while maintaining the predetermined spacing which said at least two printed products occupy in said infed imbricated formation;

retaining said at least two printed products having the predetermined spacing; and outfeeding said at least two printed products having the predetermined spacing.

2. The method as defined in claim 1, wherein:

said step of infeeding the printed products entails arranging the printed products in an imbricated formation in which each printed product bears upon the next following printed product; and said step of outfeeding said at least two printed products entails conveying the printed products in a direction which extends substantially parallel to the infeed direction.

3. The method as defined in claim 1, wherein:

said step of infeeding the printed products entails arranging the printed products in an imbricated formation in which each printed product bears upon the next following printed product; and said step of outfeeding said at least two printed products entails conveying the printed products in a direction which upwardly extends from the underside of the printed products to be engaged.

4. The method as defined in claim 1, wherein:

said step of infeeding the printed products entails arranging the printed products in an imbricated formation in which each printed product bears upon the next preceding product; and said step of outfeeding said at least two printed products entails conveying the printed products in a direction which extends substantially parallel to the infeed direction.

5. The method as defined in claim 1, wherein:

said step of infeeding the printed products entails arranging the printed products in an imbricated formation in which each printed product bears upon the next preceding printed product; and said step of outfeeding said at least two printed products entails conveying the printed products in a direction which downwardly extends from the upper side of the printed products to be engaged.

6. An apparatus for outfeeding printed products, particularly multi-sheet and preferably folded printed products having leading edges and which are infed in an imbricated formation, arranged in tandem and having a predetermined spacing and imbricatingly overlapping one another, comprising:

an infeed device for infeeding the printed products to a take-over region;

an outfeed device having a predetermined conveying direction;

individually controllable grippers arranged in tandem at said outfeed device;

said individually controllable grippers each serving to engage each time at least tow of the infed printed products at leading edges; and said individually controllable grippers having a depth which is larger than said predetermined spacing between said leading edges of said at least two infed printed products in the infed imbricated formation in order to engage and retain said at least two infed printed products with said at least two infed printed products being engaged and retained while maintaining said predetermined spacing which they occupied in the infed imbricated formation.

7. The apparatus as defined in claim 6, wherein:

said predetermined conveying direction of said outfeed device at said transfer region of the products extending essentially transversely with respect to a plane defined by the printed products to be engaged.

8. The apparatus as defined in claim 7, wherein:

said infeed device conveys the printed products in said imbricated formation in which each printed product bears upon the next following printed product; and said predetermined conveying direction of said outfeed device at said take-over region extending essentially upwardly from the underside of the printed products to be engaged.

9. The apparatus as defined in claim 7, wherein:

said infeed device conveys the printed products in said imbricated formation in which each printed product bears upon the next preceding printed product; and said predetermined conveying direction of said outfeed device at said transfer region extending essentially downwardly from the upperside of the products to be engaged.

10. The apparatus as defined in claim 6, wherein:

said infeed device possesses a predetermined infeed direction; and said predetermined conveying direction of said outfeed device at said transfer region extends essentially parallel to said predetermined infeed direction of said infeed device.

11. The apparatus as defined in claim 6, wherein:

said outfeed device comprises a revolvingly driven traction element;

said individually controllable grippers being arranged in tandem at said revolvingly driven traction element and at a predetermined distance from one another;

said revolvingly driven traction element having a predetermined conveying speed;

said infeed device having a predetermined conveying speed; and the ratio of said predetermined conveying speed of said revolvingly driven traction element to said predetermined conveying speed of said infeed device essentially corresponding with the quotient of said predetermined distance between two individually controllable grippers to twice said predetermined spacing between said leading edges of two adjacent printed products in the imbricated formation.

12. The apparatus as defined in claim 11, wherein:

each individually controllable gripper comprises two clamping jaws of which one is controllable;

said two clamping jaws comprising a leading clamping jaw and a trailing clamping jaw;

said leading clamping jaw having a free end;

the printed products to be engaged defining a plane; and said free end of said leading clamping jaw essentially maintains its position with respect to said plane of the printed products to be engaged in said take-over region when such printed products enter between said two clamping jaws.

13. The apparatus as defined in claim 12, wherein:

said trailing clamping jaw constitutes said one controllable clamping jaw;

pivot shaft means about which there are conjointly pivotable said two clamping jaws at said revolvingly driven traction element; and cam means for rocking said individually controllable grippers in said take-over region in order to maintain substantially stationary said free end of said leading clamping jaw.

14. The apparatus as defined in claim 12, wherein:

said leading clamping jaw constitutes said one controllable clamping jaw; and cam means in said take-over region for maintaining the position of said leading clamping jaw with respect to said plane of the printed products to be engaged until said trailing clamping jaw moving in said predetermined conveying direction of said outfeed device clamps the products together with said controllable leading clamping jaw.

15. The apparatus as defined in claim 14, wherein:

said controllable leading clamping jaw is operatively connected to a follower member; and said cam means comprising a closing cam extending substantially parallel to said infeed direction of said infeed device and acting upon said follower member.

16. An apparatus for outfeeding printed products, particularly multi-sheet and preferably folded printed products which are infed in an imbricated formation, arranged in tandem and having a predetermined spacing and imbricatingly overlapping one another, comprising:

an infeed device for infeeding the printed products to a take-over region;

an outfeed device having a predetermined conveying direction;

said outfeed device comprising a revolvingly driven traction element;

individually controllable grippers arranged in tandem at said revolvingly driven traction element;

said individually controllable grippers each comprising two clamping jaws which serve to clamp one single printed product;

a pivot axle extending essentially transversely to said predetermined conveying direction;

said individually controllable grippers at said revolvingly driven traction element being journalled at said pivot axle and pivotable in said take-over region by means of a control means;

said printed products to be engaged defining a plane;

said predetermined conveying direction of said outfeed device extending essentially transversely to said plane of the printed products to be engaged;

said two clamping jaws constituting a leading clamping jaw and a controllable trailing clamping jaw;

said leading clamping jaw having a free end; and each individually controllable gripper being pivotable in said take-over region the control means such that said free end of said leading clamping jaw remains essentially stationary during the travel of said one single printed product between said two clamping jaws.

* * * * *